US007422805B2

(12) United States Patent
Hessman

(10) Patent No.: US 7,422,805 B2
(45) Date of Patent: Sep. 9, 2008

(54) CUTTING TOOL FOR BIMETAL MACHINING

(75) Inventor: Ingemar Hessman, Sandviken (SE)

(73) Assignee: Sandvik Intellectual Property Aktiebolag, Sandviken (SE)

( * ) Notice: Subject to any disclaimer, the term of this patent is extended or adjusted under 35 U.S.C. 154(b) by 125 days.

(21) Appl. No.: 11/057,670

(22) Filed: Feb. 15, 2005

(65) Prior Publication Data

US 2005/0181211 A1 Aug. 18, 2005

(30) Foreign Application Priority Data

Feb. 17, 2004 (SE) ..... 0400353

(51) Int. Cl.

| | |
|---|---|
| ***B32B 9/00*** | (2006.01) |
| ***B23B 27/14*** | (2006.01) |
| ***B23B 3/00*** | (2006.01) |
| ***C23C 16/00*** | (2006.01) |

(52) U.S. Cl. ..... 428/698; 428/212; 428/216; 428/336; 428/701; 428/702; 407/119; 427/255.23; 427/255.28; 427/255.29; 427/255.31; 427/255.391; 427/419.1; 427/419.2; 427/419.7

(58) Field of Classification Search ..... 428/698, 428/699, 701, 702, 216, 212, 336
See application file for complete search history.

(56) References Cited

U.S. PATENT DOCUMENTS

| | | | | |
|---|---|---|---|---|
| 4,643,620 | A * | 2/1987 | Fujii et al. | 407/119 |
| 5,674,564 | A | 10/1997 | Ljungberg et al. | |
| 5,786,069 | A * | 7/1998 | Ljungberg et al. | 428/698 |
| 5,861,210 | A | 1/1999 | Lenander et al. | |
| 6,062,776 | A | 5/2000 | Sandman et al. | |
| 6,200,671 | B1 | 3/2001 | Lindskog et al. | |
| 6,228,139 | B1 * | 5/2001 | Oskarsson | 75/240 |
| 6,261,673 | B1 | 7/2001 | Reineck et al. | |
| 6,406,224 | B1 | 6/2002 | Östlund et al. | |
| 6,632,514 | B1 * | 10/2003 | Sulin et al. | 428/216 |
| 7,090,914 | B2 * | 8/2006 | Yamagata et al. | 428/174 |

FOREIGN PATENT DOCUMENTS

| | | |
|---|---|---|
| CA | 1336101 | 6/1995 |
| EP | 0 709 484 B2 | 5/1996 |
| EP | 0 736 615 B1 | 10/1996 |
| EP | 0 753 603 B1 | 1/1997 |
| EP | 1 008 673 A1 | 6/2000 |
| EP | 1 103 635 B1 | 5/2001 |
| EP | 1 205 569 A2 | 5/2002 |
| EP | 1 335 807 A1 | 8/2003 |
| EP | 1 352 697 A2 | 10/2003 |
| EP | 1 352 697 A3 | 10/2003 |
| SE | 511 089 C2 | 8/1999 |
| SE | 514 284 C2 | 2/2001 |
| WO | WO 02/42027 A | 5/2002 |

OTHER PUBLICATIONS

WPI/Derwent's abstract, Accession No. 1976-44503X, week 197624, Abstract of JP 49113803 A (Toyota Cent Res & Dev lab) Oct. 30, 1974.

WPI/Derwent's abstract, Accession No. 1985-022149, week 198504, Abstract of JP 59217676 A (Mitsubishi Metal Corp) Dec. 7, 1984.

WPI/Derwent's abstract, Accession No. 1982-69324E, week 198233, Abstract of JP 57111280 A (Nippoin Tungsten KK) Jul. 10, 1982.

* cited by examiner

*Primary Examiner*—Archene Tumer
(74) *Attorney, Agent, or Firm*—Drinker Biddle & Reath LLP

(57) ABSTRACT

Coated cemented carbide cutting tool inserts for bimetal machining under wet conditions at moderate cutting speeds, and in particular, cutting tool inserts for face milling of engine blocks formed from alloys of cast iron and aluminium and/or magnesium. The inserts are characterized by a submicron WC—Co cemented carbide and a coating including an inner layer of $TiC_xN_y$ with columnar grains followed by a layer of $\kappa$-$Al_2O_3$ and a top layer of TiN.

22 Claims, No Drawings

CUTTING TOOL FOR BIMETAL MACHINING

FIELD OF THE INVENTION

The present invention relates to coated cemented carbide cutting tool inserts for bimetal machining under wet conditions at moderate cutting speeds, and in particular, coated cemented carbide cutting tool inserts for face milling of engine blocks comprising alloys of aluminium and/or magnesium and cast iron.

BACKGROUND OF THE INVENTION

In a modern automobile the engine block is one of the heaviest single components. Making the block in a bimetallic manner, such as by fabricating it from an aluminium alloy and placing cast iron sleeves into the cylinder bores substantially reduces the weight of the block compared to conventional cast iron blocks. The aluminium alloy generally contains 5-10 wt-% Si as well as small amounts of other additions. The cast iron is generally grey cast iron but also pearlitic cast iron is used. The machining of a block as cast to final shape and dimension is generally made in transfer lines or flexible machining centres and the time pressure is high. An important step of the engine block manufacturing process is to provide the block with a flat upper surface for mating with the cylinder head. Often this operation is a bottleneck in the production. Machining of conventional unimetallic engine blocks (i.e. cast iron) is generally accomplished by common machining processes such as high speed milling utilizing ceramic inserts, such as silicon nitride, coated cemented carbide on the milling head. Although satisfactory when utilized for unimetallic blocks, this approach tends to produce undesirable results when used with blocks fabricated from two materials, one of which is soft, i.e., aluminium normally requires a rather high cutting speed, and the other of which is brittle, i.e., cast iron normally requires a lower cutting speed when coated cemented carbide is used. Thus, for machining of aluminium, polycrystalline diamond (PCD) is generally used. Such tools are relatively expensive, however, and wear rapidly in iron containing materials such as cast iron. Moreover, optimal milling for soft versus brittle materials is different. For example, most high-speed milling cutters made for softer materials, such as aluminium, operate most efficiently at substantially greater rake angles than those used for harder materials such as cast iron. Clearance angles, or the angle between the land and a tangent to the cutter from the tip of the tooth, also depend on the various work materials. Cast iron typically requires values of 4 to 7 degrees, whereas soft materials such as magnesium, aluminium, and brass are cut efficiently with clearance angles of 10 to 12 degrees.

When milling cutters with a close pitch are used for machining, there is a resultant change of about 30-40 inserts as they are worn out. One typical wear mechanism in the tool insert is a built up edge; however, this may lead to a bad surface finish and a failure of the cutting edge will lead to rapid wear of the insert. The main reason for multiple tool changes is the surface finish and the high demands for the surface finish, which leads to the frequent tool changes.

When wet milling is used, due to surface finish and chip evacuation requirements, emulsions used in machining may raise environmental concerns and potential health risks; thus leading to a higher cost.

EP-A-1335807 relates to a method of milling a material comprising aluminium and cast iron. By using a silicon nitride based cutting tool insert at a cutting speed of more than 1000 m/min, an unexpected increase in tool life has been obtained. However, not all transfer lines or flexible machining centres have speed capability >600 m/min.

EP-A-1205569 discloses coated milling inserts particularly useful for milling of grey cast iron, with or without cast skin, under wet conditions at low and moderate cutting speeds and milling of nodular cast iron and compacted graphite iron, with or without cast skin, under wet conditions at moderate cutting speeds. The inserts are characterized by a WC—Co cemented carbide with a low content of cubic carbides and a highly W-alloyed binder phase and a coating including an inner layer of $TiC_xN_y$ with columnar grains followed by a layer of $\kappa$-$Al_2O_3$ and a top layer of TiN.

SUMMARY OF THE INVENTION

Accordingly, there is an extremely high demand to develop tool solutions having a longer tool life and requiring less frequent tool changes.

It is therefore an object of the present invention to provide a cutting tool insert particularly useful for machining of bimetal materials.

It is a further object of the present invention to provide an improved method of machining bimetal materials with long tool lives requiring less frequent tool changes.

These and other objects are satisfied by a cutting tool insert for machining of bimetal bodies comprising cast iron and aluminium and/or magnesium alloys under wet conditions at moderate cutting speeds, said cutting tool comprising a cemented carbide body and a coating, wherein the cemented carbide body includes a substrate with the following composition: WC, 9-11 wt-% Co and suitable amount of conventional grain refiner(s) to obtain an average WC grain size of <1 μm, and wherein the coating comprises: a first, innermost layer of $TiC_xN_yO_z$ with x+y+z=1, y>x and z<0.2, with equiaxed grains with size <0.5 μm and a total thickness of 0.1-1.5 μm, a layer of $TiC_xN_y$ with x+y=1, x>0.3 and y>0.3, with a thickness of 1-4 μm with columnar grains with an average diameter of <5 μm, a layer of a smooth, fine-grained, 0.5-2 μm $\kappa$-$Al_2O_3$ with a thickness of 1-2.5 μm, and an outer layer of TiN with a thickness of <1 μm, preferably 0.5-1.0 μm.

DETAILED DESCRIPTION OF THE PREFERRED EMBODIMENTS

It has now surprisingly been found that improved performance when machining bimetal materials can be obtained with a coated cutting insert comprising:

- a substrate with the following composition: WC, 9-11, preferably 10 wt-% Co and suitable amount of conventional grain refiner(s) such as Cr, or V, preferably <0.5 wt-% Cr, to obtain an average WC grain size of <1 μm and
- a coating comprising:
  - a first, innermost, layer of $TiC_xN_yO_z$ with x+y+z=1, y>x and z<0.2, preferably y>0.8 and z=0, with equiaxed grains with size <0.5 μm and a total thickness <1.5 μm, preferably >0.1 μm.
  - a layer of $TiC_xN_y$ with x+y=1, x>0.3 and y>0.3, preferably x>0.5, with a thickness of 1-4 μm, preferably 2-2.7 μm, with columnar grains with an average diameter of <5 μm, preferably 0. 1-2 μm
  - a layer of a smooth, fine-grained, grain size about 0.5-2 μm, $Al_2O_3$ essentially comprising the K-phase. However, the layer may contain small amounts (<5 vol-%) of other phases such as θ- or the α-phase as determined by XRD-measurement. The $Al_2O_3$-layer has a thickness of 1-2.5 μm, preferably 1.2-1.7 μm a further <1 μm, preferably 0.5-1.0 μm thick layer of TiN. This outermost layer of TiN has a surface roughness $R_{max} \leqq 0.4$ μm over a length of 10 μm. The inserts have an edge radius of 10-25 μm, preferably 15 μm and a TiN-layer reduced in thickness over the edge line to 50-90% of the thickness on the rake face.

The present invention also relates to a method of making coated cutting tool inserts comprising a cemented carbide body with a composition of WC, 9-11 preferably 10 wt-% Co and suitable amount of conventional grain refiner(s) such as Cr, or V, preferably <0.5 wt-% Cr, to obtain an average WC grain size of <1 μm. The inserts are ground on the periphery to an edge hone of 10-25 μm, preferably 15 μm.

Onto the cemented carbide body is deposited a first, innermost layer of $TiC_xN_yO_z$ with x+y+z=1, y>x and z<0.2, preferably y>0.8 and z=0, with equiaxed grains with size <0.5 μm and a total thickness <1.5, preferably >0.1 μm, using known CVD-methods.

a layer of $TiC_xN_y$ with x+y=1, x>0.3 and y>0.3, preferably x>0.5, with a thickness of 1-4 μm, preferably 2-2.7 μm, with columnar grains and with an average diameter of <5 μm, preferably 0. 1-2 μm, using preferably MTCVD-technique using acetonitrile as the carbon and nitrogen source for forming the layer in the temperature range of 700-900° C. The exact conditions, however, depend to a certain extent on the design of the equipment used, a smooth $Al_2O_3$-layer comprising κ-$Al_2O_3$ deposited under conditions disclosed in e.g. U.S. Pat. No. 5,674,564, the entire contents of which is hereby incorporated by reference. The κ-$Al_2O_3$ layer has a thickness of 1-2.5 μm, preferably 1.2-1.7 μm, a <1 μm, preferably 0.5-1.0 μm thick layer of TiN with a surface roughness $R_{max} \leqq 0.4$ μm over a length of 10 μm.

The smooth coating surface is obtained by a gentle wet-blasting of the coating surface with fine grained (400-150 mesh) alumina powder or by brushing the edges with brushes, based on e.g. SiC as disclosed for example in U.S. Pat. No. 5,861,210, to obtain an edge radius of 10-25 μm, preferably 15 μm, and a TiN-layer reduced in thickness over the edge line to 50-90% of the thickness on the rake face.

The invention also relates to the use of cutting tool inserts, as described above, for machining, preferably milling, of bimetal bodies comprising cast irons such as grey cast iron, compacted graphite iron and nodular iron particularly grey cast iron and aluminium and/or magnesium alloys at a cutting speed of 200-500 m/min and a feed of 0.1-0.4 mm/tooth depending on cutting speed and insert geometry.

EXAMPLE 1

Cemented carbide machining inserts with the composition 10 wt-% Co, 0.4 wt-% Cr, and WC as the rest, with average grain size of 0.9 μm, and an edge hone of 15 μm were coated with a 0.5 μm equiaxed $TiC_{0.5}N_{0.95}$-layer (with a high nitrogen content corresponding to an estimated C/N-ratio of 0.05) followed by a 2.0 μm thick $TiC_{0.54}N_{0.46}$-layer, with columnar grains by using MTCVD-technique (temperature 850-885° C. and $CH_3CN$ as the carbon/nitrogen source). In subsequent steps during the same coating cycle, a 1.5 μm thick layer of κ-$Al_2O_3$ was deposited using a temperature 970° C. and a concentration of $H_2S$ dopant of 0.4% as disclosed in U.S. Pat. No. 5,674,564, the entire contents of which is hereby incorporated by reference. A 0.5 layer of TiN was finally deposited on top according to known CVD-technique. XRD-measurement showed that the $Al_2O_3$-layer consisted of 100% κ-phase.

The coated inserts were brushed using a nylon straw brush containing SiC grains. Examination of the brushed inserts in a light optical microscope revealed that the outermost TiN-layer had been somewhat reduced in thickness. The edge radius was about 15 μm.

EXAMPLE 2

Face milling of engine blocks was performed under the following conditions:

Operation: Face milling, finishing in wet conditions

Work piece: 4 to 6 cylinder engine block comprising aluminium 8% Si and cylinder liners of pearlitic grey cast iron with a diameter of about 10 cm and a wall thickness of about 10 mm.

Milling cutter: Auto F 260.42 of diameter 250 mm.

Cutting speed: 360 m/min

Feed rate/tooth: 0.24 mm

Depth of cut: 0.5 mm

Insert style: 28 pcs SBEX1203ZZ-11 and 4 pcs SBEN1203ZZ

Grade 1: Invention (NAB).

Grade 2: Sandvik commercial grade K20W

Tool life criterion: unacceptable surface finish including component frittering.

Result: (Because of varying number of cylinders in the blocks the result is expressed in units i.e. number of cylinders)

| | Grade 1 invention | Grade 2 reference |
|---|---|---|
| Tool life no passes: | 4500 units | 3000 units |

EXAMPLE 3

Face milling of bedplate was performed under the following conditions:

Operation: Face milling, finishing wet conditions

Work piece: Bedplate comprising aluminium 8% Si and about 15-30 mm square nodular cast iron ingots Milling cutter: Sandvik R260.8-145-12 of diameter 315 mm.

Cutting speed: 350m/min

Feed rate/tooth: 0.17 mm

Depth of cut: 0.7 mm

Insert style: R245-12T3E-PL

Grade 1: invention (NAT).

Grade 2: Sandvik commercial grade K20W (coated)

Tool life criterion: unacceptable surface finish including component frittering.

Results (Because of varying number of cylinders in the blocks the result is expressed in units i.e. number of cylinders):

| | Grade 1 invention | Grade 2 reference |
|---|---|---|
| Tool life | 1300 units | 900-1000 units |

The invention also includes all conceivable combinations of the preferred embodiments and examples described above.

Although only preferred embodiments and examples are specifically illustrated and described herein, it will be appreciated that many modifications and variations of the present invention are possible in light of the above teachings and within the purview of the appended claims without departing from the spirit and intended scope of the invention.

What is claimed is:

1. A cutting tool insert for machining of bimetal bodies comprising cast iron and aluminium and/or magnesium alloys under wet conditions at moderate cutting speeds, said cutting tool comprising a cemented carbide body and a coating, wherein said cemented carbide body includes a substrate with the following composition: WC, 9-11 wt-% Co and suitable amount of conventional grain refiner(s) to obtain an average WC grain size of<1 μm, and wherein said coating comprises:

a first, innermost layer of $TiC_xN_yO_z$ with x+y+z1, y>x and z<0.2, with equiaxed grains with size <0.5 μm and a total thickness of 0.1-1.5 μm, a layer of $TiC_xN_y$ with x+y=1, x>0.3 and y>O.3, with a thickness of 1-4 μm with columnar grains with an average diameter of <5 μm, a layer of a smooth, fine-grained, 0.5-2 μm κ-$Al_2O_3$ with a thickness of 1-2.5 μm, and an outer layer of TiN with a thickness of <1 μm, wherein the outermost TiN-layer is reduced in thickness along the cutting edge.

2. The cutting tool insert according to claim 1, wherein said cemented carbide body includes a substrate with the following composition: WC, 10 wt-% Co and suitable amount of conventional grain refiner(s) to obtain an average WC grain size of <1 μm.

3. The cutting tool insert according to claim 1, wherein said coating comprises:

the first, innermost layer of $TiC_xN_yO_z$ with x+y+z=1, y>0.8, and z=0.

4. The cutting tool insert according to claim 1, wherein said coating comprises:

the layer of $TiC_xN_y$ with x+y=1, x>0.5 and y>0.3.

5. The cutting tool insert according to claim 1, wherein said coating comprises:

the outer layer of TiN with a thickness of 0.5-1.0 μm.

6. The cutting insert according to claim 1, wherein said grain refiner(s) include at least one of Cr and V.

7. The cutting insert according to claim 6, wherein said grain refiner(s) include <0.5 wt-% Cr.

8. The cutting insert according to claim 1, wherein said insert is an insert for milling.

9. The cutting insert according to claim 1, wherein the outermost TiN-layer is reduced in thickness over the edge line to 50-90% of a thickness on a rake face of the insert.

10. The cutting insert according to claim 1, wherein an edge radius is about 15 μm.

11. The cutting insert according to claim 1, wherein the outermost TiN-layer has a surface roughness $R_{max}$<0.4 μm over a length of 10 μm.

12. The cutting insert according to claim 1, wherein the thickness of the layer of κ-$Al_2O_3$ is 1.2 to 1.7 μm.

13. Method of using the cutting tool insert according to claim 1 comprising: machining of a bimetal body comprising cast iron and aluminium and/or magnesium alloys under wet conditions at moderate cutting speeds.

14. Method of using the cutting tool insert according to claim 13 wherein said machining operation is milling.

15. Method of using the cutting tool inset according to claim 13, wherein said bimetal body is an engine block or a bedplate.

16. Method of making a cutting tool insert, for machining of bimetal bodies comprising cast iron and aluminium and/or magnesium alloys under wet conditions at moderate cutting speeds, comprising a cemented carbide body and a coating, said method comprising:

providing a substrate with the following composition: WC, 9-11 wt-% Co, and suitable amount of conventional grain refiner(s) to obtain an average WC grain size of <1 μm, coating the substrate with a first, innermost layer of $TiC_xN_yO_z$ with x+y+z=1, y>x and z<0.2, with equiaxed grains with size <0.5 μm using known CVD-methods, a layer of $TiC_xN_y$ with x+y=1, x>0.3 and y>0.3, with a thickness of 1-4 μm with columnar grains with an average diameter of <5 μm deposited by MTCVD-technique, using acetonitrile as the carbon and nitrogen source for forming the layer in a temperature range of 700-900 ° C., a layer of a smooth CVD-κ-$Al_2O_3$ with a thickness of 1-2.5 μm, and a layer of CVD-TiN with a thickness of <1 μm, wherein the outermost TiN-layer is reduced in thickness along the cutting edge.

17. Method of making a cutting tool insert according to claim 16, wherein said cemented carbide body includes a substrate with the following composition: WC, 10 wt-% Co and suitable amount of conventional grain refiner(s) to obtain an average WC grain size of <1 μm.

18. Method of making a cutting tool insert according to claim 16, wherein said grain refiner(s) include <0.5 wt-% Cr.

19. Method of making a cutting tool insert according to claim 16, wherein said coating comprises:

the first, innermost layer of $TiC_xN_yO_z$ with x+y+z=1, y>0.8, and z=0.

20. Method of making a cutting tool insert according to claim 16, wherein said coating comprises:

the layer of $TiC_xN_y$ with x+y=1, ≧0.5.

21. Method of making a cutting tool insert according to claim 16, wherein said coating comprises:

the layer of CVD-TiN with a thickness of 0.51.0 μm.

22. Method of making a cutting tool insert according to claim 16, wherein said grain refiner(s) include Cr or V.

* * * * *